US005454963A

United States Patent [19]

Kaneko

[11] Patent Number: 5,454,963

[45] Date of Patent: Oct. 3, 1995

[54] REFRIGERATING MACHINE OIL COMPOSITION CONTAINING AN EPOXY COMPOUND

[75] Inventor: Masato Kaneko, Ichihara, Japan

[73] Assignee: Idemitsu Kosan Co., Ltd., Tokyo, Japan

[21] Appl. No.: 194,566

[22] Filed: Feb. 10, 1994

[30] Foreign Application Priority Data

Feb. 19, 1993 [JP] Japan ..... 5-030033
Feb. 19, 1993 [JP] Japan ..... 5-030034

[51] Int. Cl.[6] ..... C10M 129/18; C09K 5/02

[52] U.S. Cl. ..... 252/52 R; 252/68; 252/52 A

[58] Field of Search ..... 252/52 A, 68, 252/52 R

[56] References Cited

U.S. PATENT DOCUMENTS

| | | | |
|---|---|---|---|
| 2,552,084 | 5/1951 | Bishop et al. | 252/68 |
| 4,248,726 | 2/1981 | Uchinuma et al. | 252/52 A |
| 4,267,064 | 5/1981 | Sasaki et al. | 252/52 A |
| 4,431,557 | 2/1984 | Shimizu et al. | 252/52 A |
| 4,454,052 | 6/1984 | Shoji et al. | 252/68 |
| 5,100,569 | 3/1992 | Nalewajek et al. | 252/52 A |
| 5,145,594 | 9/1992 | Anton et al. | 252/68 |
| 5,152,926 | 10/1992 | Brown | 252/68 |
| 5,185,089 | 2/1993 | Thomas et al. | 252/68 |
| 5,269,955 | 12/1993 | Kawaguchi et al. | 252/52 A |

FOREIGN PATENT DOCUMENTS

| | | |
|---|---|---|
| 377122 | 7/1990 | European Pat. Off. . |
| 0399817 | 11/1990 | European Pat. Off. . |
| 533165 | 3/1993 | European Pat. Off. . |
| 2820640 | 2/1979 | Germany . |
| 1333276 | 10/1973 | United Kingdom . |

OTHER PUBLICATIONS

Database WPI, Section CH, Week 7404, Derwent Publications Ltd. Jan. 1973.

*Primary Examiner*—Prince Willis, Jr.
*Assistant Examiner*—James M. Silberman
*Attorney, Agent, or Firm*—Antonelli, Terry, Stout & Kraus

[57] ABSTRACT

There is disclosed a refrigerating machine oil composition which comprises a base oil such as polyglycol, polyvinyl ether or the like which base oil is blended with an epoxy compound represented by the general formula (I)

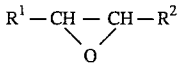

(I)

wherein $R^1$ and $R^2$ are as defined in the text of the present specification or with at least one epoxy compound selected from the group consisting of D-limonene oxide, L-limonene oxide, α-pinene oxide and L-carvone oxide. The composition is excellent in stability, sludge preventive properties, copper-plating preventive properties, etc. and is particularly effective for use in an automobile air conditioner, a room air conditioner, a refrigerator, etc., thereby making itself extremely valuable from the viewpoint of industrial utilization.

10 Claims, No Drawings

REFRIGERATING MACHINE OIL COMPOSITION CONTAINING AN EPOXY COMPOUND

BACKGROUND OF THE INVENTION

1. Field of the Invention

The present invention relates to a refrigerating machine oil composition. More particularly, it pertains to a refrigerating machine oil composition which exhibits excellent stability, sludge preventive properties and copper-plating preventive properties.

2. Description of Related Art

There have heretofore been employed a variety of refrigerating machine oils as lubricating oils for various refrigerating machines to be used in automobile air conditioners, refrigerators, room air conditioners and the like. Since such refrigerating machine oils are in use for a long period of time, these oils are required to be highly reliable.

However, such various disadvantages are found in the use of the conventional refrigerating machine oils such as the generation of copper plating, unsatisfactory stability, rise in total acid number and sludge formation. In view of the above, there are proposed and used compositions comprising various base oils in various combination with additives.

Nevertheless, it can not be said that any of the above-proposed compositions now in use is satisfactory from the viewpoint of practical application. In particular, importance has been attached to environmental problems in recent years with the result that the use of a specified flon refrigerant was sustained which threatens destruction of the ozone layer. Herein, flon means fluorochlorocarbon, fluorochlorohydrocarbon, fluorohydrocarbon or fluorocarbon. Consequently, some alternative refrigerants have emerged, and thus it is hoped that a refrigerating machine oil well suited to such refrigerants will be developed as early as possible.

The research and development of such refrigerating machine oil, however, are only in the initial stages thus revealing that in actual practice that achievement of such oils is not yet sufficient.

Under such circumstances, intensive research and development were made by the present inventor in order to develop a refrigerating machine oil which is excellent in stability, sludge preventive properties and copper-plating preventive properties, capable of being used with high reliability over a long period of time, and also well suited not only for use with the conventional specified flon refrigerants but also with various alternative refrigerants free from the fear of causing environmental pollution.

As a result, it has been found by the present inventor that the objective performance is satisfied by a composition comprising a base oil blended with a specific epoxy compound. Thus, the present invention has been accomplished on the basis of the above-mentioned finding and information.

SUMMARY OF THE INVENTION

The present invention provides a refrigerating machine oil composition which comprises a base oil blended with a specific epoxy compound. In particular, the present invention provides a refrigerating machine oil composition which comprises a base oil blended with an epoxy compound represented by the general formula (I)

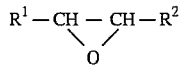

(I)

wherein $R^1$ is a hydrogen atom or an alkyl group having 1 to 20 carbon atoms, and $R^2$ is an alkyl group having 4 to 20 carbon atoms or a hydroxyalkyl group having 4 to 20 carbon atoms, or at least one epoxy compound selected from the group consisting of D-limonene oxide, L-limonene oxide, α-pinene oxide and L-carvone oxide.

The refrigerating machine oil composition according to the present invention is employed in a variety of refrigerating machines, and is well suited for use in a compression type refrigerating cycle which is usually composed at least of a compressor, a condenser, an expansion valve or a capillary tube and an evaporator.

DESCRIPTION OF PREFERRED EMBODIMENT

The base oil to be used in the refrigerating machine oil composition as the lubricating oil according to the present invention is exemplified by various base oils such as those which have heretofore been used in the refrigerating machine oil without specific limitation. The kinematic viscosity of the base oil to be used is usually 5 to 500 cSt at 40° C. , preferably 10 to 300 cSt at 40° C.

The type of the base oil may be either a mineral oil or a synthetic oil, and is preferably at least one oxygen-atom-containing compound selected from the group consisting of a polyglycol and a polyvinyl ether or a mixture of said compound and a hydrocarbon compound.

A wide variety of polyglycols are available. Preferable examples among them include a polyglycol represented by the general formula II (polyoxyalkylene glycol derivative)

$$R^3[(OR^4)_mOR^5]_n \quad \text{(II)}$$

wherein $R^3$ is a hydrogen atom or an alkyl group having 1 to 10 carbon atoms, $R^4$ is an alkylene group having 1 to 10 carbon atoms, $R^5$ is a hydrogen atom or an alkyl group having 1 to 10 carbon atoms, n is an integer of 1 to 6, preferably 1, and m is such a number that causes the average of m×n to be 6 to 80. (Refer to Japanese Patent Application Laid-Open No. 305893/1990.)

Specific examples of the polyglycols include polyoxypropylene glycol, mono or di-methyl ether derivative of polyoxypropylene glycol [for example, $CH_3O(CH(CH_3)CH_2O)_mCH_3$], mono or di-ethyl ether derivative of polyoxypropylene glycol, mono-n-butyl ether derivative of polyoxypropylene glycol, polyoxyethylene glycol, mono or dimethyl ether derivative of polyoxyethylene glycol/polyoxyethylene glycol [for example, $CH_3O(CH(CH_3)CH_2O)_x(CH_2CH_2O)_y—CH_3$; x+y=m].

On the other hand, a wide variety of polyvinyl ethers are available. Preferable examples among them include a vinyl ether-based polymer having the constitutional unit represented by the general formula (III)

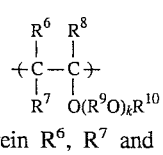

(III)

wherein $R^6$, $R^7$ and $R^8$ are each a hydrogen atom or a hydrocarbon radical, especially an alkyl group, having 1 to 10 carbon atoms; $R^9$ is a divalent hydrocarbon radical, especially an alkylene group, having 1 to 10 carbon atoms or a divalent ether-linkage oxygen atom-containing hydrocarbon radical, especially an alkoxy group-containing alkylene group, having 2 to 20 carbon atoms; $R^{10}$ is a hydrocarbon radical, especially an alkylene group, having 1 to 10 carbon atoms; k is a number from 0 to 10, preferably 0 to 5 in average; $R^6$ to $R^{10}$ may be the same as or different from each other per each constitutional unit; and $R^9$, when contained in plural in the constitutional units, may be the same or different.

Specific examples of the polyvinyl ethers include poly(vinyl ethyl ether)[for example, $CH_3CH_2O[CH_2CH(OCH_2CH_3)]_iH$ wherein i is an integer], poly(vinyl octyl ether) and poly(vinyl butoxypropyl ether).

The hydrocarbon compound to be employed in the form of mixture with the above-mentioned polyglycol or polyvinyl ether is exemplified by a mineral oil, an olefinic polymer and a synthetic oil such as alkylbenzene and alkylnaphthalene each having a kinematic viscosity at 40° C. of 5 to 500 cSt, preferably 10 to 300 cSt. Preferable oils among them are alkylbenzene in which the total number of carbon atoms in alkyl group(s) is 1 to 50 and alkylnaphthalene in which the total number of carbon atoms in alkyl group(s) is 1 to 50.

As mentioned hereinbefore, the preferable examples of the base oil to be used in the refrigerating machine oil composition as the lubricating oil according to the present invention include at least one oxygen-atom-containing compound selected from the polyglycol and the polyvinyl ether or a mixture of said compound and the aforesaid hydrocarbon compound. In the case where a mixture of the oxygen-atom-containing compound and the hydrocarbon compound is employed, the ratio of the former compound to the latter compound may be suitably selected according to the situation, and is determined in the range of preferably 100/0 to 10/90 by weight.

Aside from the foregoing, there are available a wide variety of epoxy compounds that are to be blended with the above-mentioned base oil. Preferable examples among them include the epoxy compound represented by the general formula

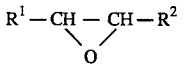

(I)

wherein $R^1$ is a hydrogen atom or an alkyl group having 1 to 20, preferably 1 to 15 carbon atoms, and $R^2$ is an,alkyl group having 4 to 20, preferably 5 to 18 carbon atoms or a hydroxyalkyl group having 4 to 20, preferably 5 to 18 carbon atoms and at least one epoxy compound selected from the group consisting of D-limonene oxide, L-limonene oxide, α-pinene oxide and L-carvone oxide.

Examples of the epoxy compound represented by the general formula (I) include 1,2-epoxyhexadecane; 1,2-epoxytetradecane; 1,2-epoxydodecane; 1,2-epoxydecane; 5,6-epoxyoctane- 1-ol; 13,14-epoxystearyl alcohol; 3,4-epoxytetradecane; 7,8-epoxytetradecane; 8,9-epoxyoctadecane-1-ol; and 3,4-epoxydecane-l-ol.

Other epoxy compound to be blended with the base oil is exemplified by D-limonene oxide, L-limonene oxide, α-pinene oxide and L-carvone oxide.

The aforestated epoxy compound is employed alone or in combination with at least one other epoxy compound as exemplified above.

The compounding ratio of the above-mentioned epoxy compound in the refrigerating machine oil according to the present invention varies depending on various conditions and can not unequivocally be determined. However, it is selected in the range of usually 0.05 to 10% by weight, preferably 0.2 to 5% by weight based on the whole composition. An unreasonably low compounding ratio of the epoxy compound leads to difficulty in achieving the expected effect, whereas an excessively high compounding ratio thereof results in failure to attain the effect which is directly proportional to the compounding ratio.

As described hereinbefore, the refrigerating machine oil composition according to the present invention comprises the aforestated base oil and epoxy compound, but may further comprises, when desired, any of various additives that are in use in the conventional lubricating oils such as extreme pressure agent, stabilizing agent, metal deactivator (especially copper deactivator), defoaming agent, chlorine scavenger, detergent-dispersant, viscosity-index improver, oiliness agent, abrasion-resistant additive, rust preventive, corrosion inhibitor and pour point depressant.

As the extreme pressure agent, there can be mentioned a phosphoric ester and a phosphorous ester. As the stabilizing agent, there can be mentioned a phenol-based antioxidant, an amine-based antioxidant and an epoxy-based antioxidant (phenylglycidyl ether, cyclohexene oxide, epoxidized soybean oil, etc.). As the copper deactivator, mention can be made of benzotriazole and a derivative thereof. As the defoaming agent, mention can be made of silicone oil (dimethylpolysiloxane, etc.) and fluorinated silicone.

The refrigerating machine oil composition according to the present invention is excellent in compatibility not only with the conventional specified flon refrigerants but also with various alternative flon refrigerants that have been developed in recent years. Consequently, the refrigerating machine oil composition according to the present invention is well suited for the lubrication of refrigerating machines, especially compression type refrigerating machines in which different kinds of flon refrigerants are employed.

Examples of the flon refrigerants that are used in the refrigerating machines include R134a(1,1,1,2-tetrafluoroethane, R12(dichlorodifluoromethane), R22(chlorodifluoromethane), R502[azeotropic mixture of R22and R115(1-chloro-1,1, 2,2,2-pentafluoroethane], R152a(1,1-difluoroethane), R125(1,1,1,2,2-pentafluoroethane), R143a(1,1,1-trifluoroethane), R32(difluoromethane), R23(trifluoromethane), R225cb(1,3-dichloro-1,1,2,2,3-pentafluoropropane), R225ca(1,1-dichloro-2,2,3,3,3-pentafluoropropane), R141b(1,1-dichloro-1-fluoroethane), R123(1,1-dichloro-2,2,2-trifluoroethane), R142b(1-chloro-1,1-difluoroethane) and R124(1-chloro-1,2,2,2-tetrafluoroethane). Particularly preferable flon refrigerants among them are those not containing chlorine atom, that is, a fluorohydrocarbon series flon refrigerant from the viewpoint of preventing environmental destruction.

As described hereinbefore, the refrigerating machine oil composition according to the present invention is excellent in stability, sludge preventive properties and copper-plating preventive properties and at the same time, exhibits excellent compatibility not only with the conventional specified flon refrigerants but also with various alternative flon refrigerants free from the fear of causing environmental pollution.

Therefore, the refrigerating machine oil composition according to the present invention is particularly effective for use in automobile air conditioner, room air conditioners, refrigerators and the like, thus rendering itself extremely valuable from the standpoint of industrial utilization.

In the following, the present invention will be described in more detail with reference to the examples and the comparative examples, which however shall not be construed to limit the present invention thereto.

EXAMPLES 1 to 8 AND COMPARATIVE EXAMPLES 1 to 3

Refrigerating machine oil compositions as lubricating oils were prepared by the use of the base oils each having the physical properties as given in Table 1 and by blending any of various epoxy compounds therewith.

The symbols of the base oils in Tables 1 to 5 are described in detail as follows:

PAG: polyalkylene glycol (polypropylene glycol dimethyl ether)

PVE: polyvinyl ether [poly(vinyl ethyl ether)]

Alkylbenzene: dodecylbenzene

PC: polycarbonate (polypropylene glycol polycarbonate)

Ester: dipentaerythritol hexahexanoate

TABLE 1

(Physical properties of base oils)

| Physical properties | Type | | | | |
|---|---|---|---|---|---|
| | PAG | PVE | Alkylbenzene | PC | Ester |
| Kinematic viscosity at 40° C. (cSt) | 42.69 | 41.99 | 37.81 | 111.8 | 71.97 |
| Kinematic viscosity at 100° C. (cSt) | 9.384 | 5.961 | 4.679 | 10.28 | 10.04 |
| Viscosity index | 212 | 79 | −32 | 62 | 122 |

Thereafter, in a 250 ml pressure resistant vessel were placed 50 g of any of the above-prepared refrigerating machine oil compositions, 25 g of R134a as the refrigerant, 100 ml of air, water in a proportion of 0.5% by weight based on the oil composition and a catalyst comprising iron, copper and aluminum, and the vessel was hermetically sealed and then allowed to stand at 175° C. for 10 days. Thereafter the vessel was opened, and investigations were made on the appearance of the oil composition, the appearance of the catalyst, the total acid number of the oil composition and the formation of any sludge. The results are given in Table 2

The symbols of the epoxy compounds (A to F) in Tables 1 to 5 are described in detail as follows:

A: 1,2-epoxyhexadecane

B: 1,2-epoxydodecane

C: 5,6-epoxyoctane-1-ol

D: D-limonene oxide

E: α-pinene oxide

F: L-carvone oxide

TABLE 2

(Refrigerant: R134a)

| No. | Base oil type | Base oil amount (wt %) | Epoxy compound type | Epoxy compound amount (wt %) | Appearance of oil composition | Appearance of catalyst | Total acid number | Sludge formation |
|---|---|---|---|---|---|---|---|---|
| Example 1 | PAG | 98.0 | A | 2.0 | good | good | 0.1> | not formed |
| Example 2 | PAG | 98.0 | B | 2.0 | good | good | 0.1> | not formed |
| Example 3 | PAG | 98.0 | C | 2.0 | good | good | 0.1> | not formed |
| Example 4 | PVE | 98.0 | A | 2.0 | good | good | 0.1> | not formed |
| Example 5 | PVE | 98.0 | B | 2.0 | good | good | 0.1> | not formed |
| Example 6 | PVE | 98.0 | C | 2.0 | good | good | 0.1> | not formed |
| Example 7 | PAG<br>alkylbenzene | 50.0<br>48.0 | A | 2.0 | good | good | 0.1> | not formed |
| Example 8 | PVE<br>alkylbenzene | 30.0<br>68.0 | C | 2.0 | good | good | 0.1> | not formed |
| Comparative Example 1 | PAG | 100 | — | — | yellow | good | 0.6 | not formed |
| Comparative Example 2 | PVE | 100 | — | — | yellow | good | 0.7 | not formed |
| Comparative Example 3 | alkylbenzene | 100 | — | — | yellow | good | 0.3 | not formed |

EXAMPLES 9 to 13 AND COMPARATIVE EXAMPLES 4 to 7

Refrigerating machine oil compositions as lubricating oils were prepared by the use of the base oils each having the physical properties as given in Table 1 and by blending any of various epoxy compounds therewith.

Thereafter, in a 250 ml pressure resistant vessel were placed 50 g of any of the above-prepared refrigerating machine oil compositions, 25 g of R12 as the refrigerant, 100 ml of air, water in a proportion of 0.5% by weight based on the oil composition and a catalyst comprising iron, copper and aluminum, and the vessel was hermetically sealed and then allowed to stand at 175° C. for 10 days. Thereafter the vessel was opened, and investigations were made on the appearance of the oil composition, the appearance of the catalyst, the total acid number of the oil composition and the formation of any sludge. The results are given in Table 3.

TABLE 3

(Refrigerant: R12)

| No. | Base oil type | Base oil amount (wt %) | Epoxy compound type | Epoxy compound amount (wt %) | Appearance of oil composition | Appearance of catalyst | Total acid number | Sludge formation |
|---|---|---|---|---|---|---|---|---|
| Example 9 | PAG | 98.0 | A | 2.0 | good | good | 0.1> | not formed |
| Example 10 | PVA | 98.0 | B | 2.0 | good | good | 0.1> | not formed |
| Example 11 | PAG | 50.0 | A | 1.0 | good | good | 0.1> | not formed |
| | alkylbenzene | 48.0 | C | 1.0 | | | | |
| Comparative Example 4 | PAG | 100 | — | — | black | copper-plating formed | 13 | formed |
| Comparative Example 5 | PVE | 100 | — | — | black | copper-plating formed | 14 | formed |
| Example 12 | Ester | 98.0 | A | 2.0 | brown | iron blackened | 7.0 | slightly formed |
| Example 13 | PC | 98.0 | B | 2.0 | brown | iron blackened | 1.2 | slightly formed |
| Comparative Example 6 | Ester | 100 | — | — | black | copper-plating formed | 29 | formed |
| Comparative Example 7 | PC | 100 | — | — | black | copper-plating formed | 13 | formed |

EXAMPLES 14 to 21 AND COMPARATIVE EXAMPLES 8 to 10

Refrigerating machine oil compositions as lubricating oils were prepared by the use of the base oils each having physical properties as given in Table 1 and by blending any of various epoxy compound therewith.

Thereafter, in a 250 ml pressure resistant vessel were placed 50 g of any of the above-prepared refrigerating machine oil compositions, 25 g of R134 a as the refrigerant, 100 ml of air, water in a proportion of 0.5% by weight based on the oil composition and a catalyst comprising iron, copper and aluminum, and the vessel was hermetically sealed and then allowed to stand at 175° C. for 10 days. Thereafter the vessel was opened, and investigations were made on the appearance of the oil composition, the appearance of the catalyst, the total acid number of the oil composition and the formation of any sludge. The results are given in Table 4.

EXAMPLES 22 to 26 AND COMPARATIVE EXAMPLES 11 to 14

Refrigerating machine oil compositions as lubricating oils were prepared by the use of the base oils each having the physical properties as given in Table 1 and by blending any of various epoxy compounds therewith.

Thereafter, in a 250 ml pressure resistant vessel were placed 50 g of any of the above-prepared refrigerating machine oil compositions, 25 g of R12 as the refrigerant, 100 ml of air, water in a proportion of 0.5% by weight based on the oil composition and a catalyst comprising iron, copper and aluminum, and the vessel was hermetically sealed and then allowed to stand at 175° C. for 10 days. Thereafter the vessel was opened, and investigations were made on the appearance of the oil composition, the appearance of the catalyst, the total acid number of the oil composition and the formation of any sludge. The results are given in Table 5.

TABLE 4

(Refrigerant: R134a)

| No. | Base oil type | Base oil amount (wt %) | Epoxy compound type | Epoxy compound amount (wt %) | Appearance of oil composition | Appearance of catalyst | Total acid number | Sludge formation |
|---|---|---|---|---|---|---|---|---|
| Example 14 | PAG | 98.0 | D | 2.0 | good | good | 0.1> | not formed |
| Example 15 | PAG | 98.0 | E | 2.0 | good | good | 0.1> | not formed |
| Example 16 | PAG | 98.0 | F | 2.0 | good | good | 0.1> | not formed |
| Example 17 | PVE | 98.0 | D | 2.0 | good | good | 0.1> | not formed |
| Example 18 | PVE | 98.0 | E | 2.0 | good | good | 0.1> | not formed |
| Example 19 | PVE | 98.0 | F | 2.0 | good | good | 0.1> | not formed |
| Example 20 | PAG | 50.0 | D | 2.0 | good | good | 0.1> | not formed |
| | alkylbenzene | 48.0 | | | | | | |
| Example 21 | PVE | 30.0 | F | 2.0 | good | good | 0.1> | not formed |
| | alkylbenzene | 68.0 | | | | | | |
| Comparative Example 8 | PAG | 100 | — | — | yellow | good | 0.6 | not formed |
| Comparative Example 9 | PVE | 100 | — | — | yellow | good | 0.7 | not formed |
| Comparative Example 10 | alkylbenzene | 100 | — | — | yellow | good | 0.3 | not formed |

TABLE 5

(Refrigerant: R12)

| No. | Base oil type | Base oil amount (wt %) | Epoxy compound type | Epoxy compound amount (wt %) | Appearance of oil composition | Appearance of catalyst | Total acid number | Sludge formation |
|---|---|---|---|---|---|---|---|---|
| Example 22 | PAG | 98.0 | D | 2.0 | good | good | 0.1> | not formed |
| Example 23 | PVA | 98.0 | E | 2.0 | good | good | 0.1> | not formed |
| Example 24 | PAG | 50.0 | D | 1.0 | good | good | 0.1> | not formed |
| | alkylbenzene | 48.0 | F | 1.0 | | | | |
| Comparative Example 11 | PAG | 100 | — | — | black | copper-plating formed | 13 | formed |
| Comparative Example 12 | PVE | 100 | — | — | black | copper-plating formed | 14 | formed |
| Example 25 | Ester | 98.0 | D | 2.0 | brown | iron blackened | 5.7 | slightly formed |
| Example 26 | PC | 98.0 | E | 2.0 | brown | iron blackened | 0.9 | slightly formed |
| Comparative Example 13 | Ester | 100 | — | — | black | copper-plating formed | 29 | formed |
| Comparative Example 14 | PC | 100 | — | — | black | copper-plating formed | 13 | formed |

What is claimed is:

1. A refrigerating machine oil composition which comprises a base oil and at least one epoxy compound selected from the group consisting of D-limonene oxide, L-limonene oxide, α-pinene oxide and L-carvone oxide, said epoxy compound being blended with said base oil.

2. The composition according to claim 1 wherein the at least one epoxy compound selected from the group consisting of D-limonene oxide, L-limonene oxide, α-pinene oxide and L-carvone oxide is blended in an amount of 0.05 to 10% by weight based on the whole amount of the composition.

3. The composition according to claim 1 wherein the base oil is at least one oxygen-atom-containing compound selected from the group consisting of polyglycol and polyvinyl ether.

4. The composition according to claim 3, wherein the polyvinyl ether is a vinyl ether-based polymer having the constitutional unit represented by the general formula:

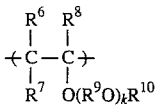

(III)

wherein $R^6$, $R^7$ and $R^8$ are each a hydrogen atom or a hydrocarbon radical having 1 to 10 carbon atoms; $R^9$ is a divalent hydrocarbon radical having 1 to 10 carbon atoms or a divalent ether-linkage oxygen atom-containing hydrocarbon radical having 2 to 20 carbon atoms; $R^{10}$ is a hydrocarbon radical having 1 to 10 carbon atoms; k is a number from 0 to 10 in average; $R^6$ to $R^{10}$ may be the same as or different from each other per each constitutional unit; and $R^9$, when contained in plural in the constitutional unit, may be the same or different.

5. The composition according to claim 4, wherein $R^6$, $R^7$ and $R^8$ are each an alkyl group, $R^9$ is an alkylene group and $R^{10}$ is an alkylene group.

6. The composition according to claim 3, wherein the polyglycol is a polyoxyalkylene glycol derivative represented by the general formula:

$$R^3[(OR^4)_mOR^5]_n \quad \text{(II)}$$

wherein $R^3$ is a hydrogen atom or an alkyl group having 1 to 10 carbon atoms, $R^4$ is an alkylene group having 1 to 10 carbon atoms, $R^5$ is a hydrogen atom or an alkyl group having 1 to 10 carbon atoms, n is an integer of 1 to 6 and m is such a number that causes the average of m×n to be 6 to 80.

7. The composition according to claim 1 wherein the base oil is a mixture of a hydrocarbon compound and at least one oxygen-atom-containing compound selected from the group consisting of polyglycol and polyvinyl ether.

8. The composition according to claim 7, wherein the polyvinyl ether is a vinyl ether-based polymer having the constitutional unit represented by the general formula:

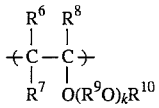

(III)

wherein $R^6$, $R^7$ and $R^8$ are each a hydrogen atom or a hydrocarbon radical having 1 to 10 carbon atoms; $R^9$ is a divalent hydrocarbon radical having 1 to 10 carbon atoms or a divalent ether-linkage oxygen atom-containing hydrocarbon radical having 2 to 20 carbon atoms; $R^{10}$ is a hydrocarbon radical having 1 to 10 carbon atoms; k is a number from 0 to 10 in average; $R^6$ to $R^{10}$ may be the same as or different from each other per each constitutional unit; and $R^9$, when contained in plural in the constitutional unit, may be the same or different.

9. The composition according to claim 8, wherein $R^6$, $R^7$ and $R^8$ are each an alkyl group, $R^9$ is an alkylene group and $R^{10}$ is an alkylene group.

10. The composition according to claim 7, wherein the polyglycol is a polyoxyalkylene glycol derivative represented by the general formula:

$$R^3[(OR^4)_mOR^5]_n \quad \text{(II)}$$

wherein $R^3$ is a hydrogen atom or an alkyl group having 1 to 10 carbon atoms, $R^4$ is an alkylene group having 1 to 10 carbon atoms, $R^5$ is a hydrogen atom or an alkyl group having 1 to 10 carbon atoms, n is an integer of 1 to 6 and m is such a number that causes the average of m×n to be 6 to 80.

* * * * *